United States Patent [19]

Leung

[11] 4,184,461

[45] Jan. 22, 1980

[54] ACCELERATION ENRICHMENT FOR CLOSED LOOP CONTROL SYSTEMS

[75] Inventor: Chun K. Leung, Farmington Hills, Mich.

[73] Assignee: The Bendix Corporation, Southfield, Mich.

[21] Appl. No.: 836,333

[22] Filed: Sep. 26, 1977

[51] Int. Cl.[2] ..... F02D 5/00; F02M 7/06

[52] U.S. Cl. ..... 123/32 EH; 123/32 EA; 123/32 ED; 123/119 EC

[58] Field of Search ..... 123/32 EH, 32 EL, 32 EJ, 123/32 ED, 32 EA, 32 EE, 119 EC

[56] References Cited

U.S. PATENT DOCUMENTS

| | | | |
|---|---|---|---|
| 3,661,126 | 5/1972 | Baxendale | 123/32 EH |
| 3,673,989 | 7/1972 | Aono et al. | 123/32 EH |
| 3,759,231 | 9/1973 | Endo | 123/32 EH |
| 3,786,788 | 1/1974 | Suda et al. | 123/32 EA |
| 3,789,816 | 2/1974 | Taplin et al. | 123/32 EA |
| 4,010,717 | 3/1977 | Taplin | 123/32 EH |
| 4,048,964 | 9/1977 | Kissel | 123/32 EA |
| 4,075,982 | 2/1978 | Asano et al. | 123/32 EL |
| 4,077,364 | 3/1978 | Aoki | 123/32 EH |
| 4,079,711 | 3/1978 | Hattori et al. | 123/32 EE |
| 4,088,095 | 5/1978 | Aono | 123/32 EE |
| 4,112,879 | 9/1978 | Assenheimer et al. | 123/32 EH |

FOREIGN PATENT DOCUMENTS 2658948 7/1977 Fed. Rep. of Germany ..... 123/32 EH

*Primary Examiner*—Charles J. Myhre
*Assistant Examiner*—Andrew M. Dolinar
*Attorney, Agent, or Firm*—William A. Marvin; Russel C. Wells

[57] ABSTRACT

An acceleration enrichment feature for a closed loop fuel management system controlling the air/fuel mixture delivered to an internal combustion engine to regulate the roughness of the engine at a predetermined level. The enrichment feature provides increased fuel to the engine for operator induced transient conditions proportionately by sensing the rate of change of throttle angle. A throttle angle position signal is modified by circuitry providing a transfer function that introduces a lag term into the throttle angle position signal which differentiating the signal to determine the rate of change of throttle angle. The modified throttle angle position signal is additionally corrected by the amount of roughness sensed by the closed loop control and enriched for rough operations of the engine beyond a threshold and leaned for smooth operations of the engine. Acceleration enrichment pulses of a frequency dependent on the magnitude of the corrected throttle position signal are then combined with the basic fuel injection pulses of the closed loop fuel management system to provide a desired A/F ratio during operator induced transients.

20 Claims, 8 Drawing Figures

ACCELERATION ENRICHMENT FOR CLOSED LOOP CONTROL SYSTEMS

BACKGROUND OF THE INVENTION

1. Field of the Invention

The invention pertains generally to the field of electronic fuel management systems for internal combustion engines and is more particularly directed to an acceleration enrichment feature during operator induced transients for closed loop fuel management systems.

2. Prior Art

There has been recognized in the electronic fuel injection art the need for fuel enrichment during certain transient conditions. Of the most important transients are those that are operator or driver induced and commonly termed accelerations or decelerations. The driveability of the automobile will be detrimentally effected if the fuel management system does not provide the right air/fuel mixture during these conditions. Electronic control units for electronic fuel injection systems today normally have auxiliary circuits of various types for enriching the fuel mixture during acceleration and decreasing or terminating the enrichment during decelerations.

Generally, the auxiliary circuits have a sensing means for determining that enrichment is necessary and for calculating an amount of enrichment based on the change or rate of change in some parameter such as manifold pressure, throttle angle, RPM, etc. These parameters or variables and combinations thereof provide a direct method of sensing the transient conditions and their magnitudes are substantially proportional to the enrichment needed.

The auxiliary circuits then commonly lengthen or provide additional acceleration enrichment (AE) pulses to the base fuel pulse produced by the fuel management system. According to this operation, the main fuel management system sets a desired air/fuel ratio that is correct for nontransient conditions and the auxiliary circuits provide the enrichment needed for the proper air/fuel mixture during transient condition.

While this theory of operation is correct in the macro sense in that many main fuel management systems do provide a desired average air/fuel ratio, the theory breaks down in the micro sense for closed loop systems. These systems provide means for correction toward the desired air/fuel ratio or operating point and are continually hunting for that value. It is generally understood that with modern closed loop integral control, most of the system operation is not exactly at the desired ratio. At any instant, the air/fuel ratio maybe more or less than the desired value and it is only the summation or average of the instantaneous points that produce a desired fuel ratio.

Therefore, it is seen that if the auxiliary circuit provides acceleration enrichment based only on the transient variables when injecting additional or lengthening the basic pulse width during air/fuel ratios that are rich the combination will be excessively rich and conversely when injecting pulses or modifying pulse width during lean excursions the combination will not be rich enough. These differences between the ideal response and the actual response of the air/fuel ratio will tend to average out for very long accelerations but at the expense of smooth and instantaneous accelerations.

Moreover, when the actual operating conditions of the engine are not accounted for, particularly when in some systems the closed loop control is cut out during transient conditions, the system may operate far from the desired operating point causing emissions to rise considerably or the before-mentioned driveability problems. The closed loop integral controllers will return to the desired operating point at some integration rate after cessation of the transient but the further the transient has moved the system from the desired point, the longer it will take to return it. For example, with a system operating rich with the integral controller still heading in the rich direction, an acceleration enrichment transient will shift the operation substantially from that desired.

Thus, a better method can be devised where the acceleration enrichment is not only a function of the parameters that are directly changed because of operator induced transient conditions but also is a function of the instantaneous operating condition of the engine. Varying the acceleration enrichment to increase the amount of enrichment during lean engine operations and decrease the amount of enrichment during rich engine operations will produce a system more closely related to the ideal.

One of the more advantageous types of closed loop integral controller systems in the prior art uses an $O_2$ sensor for detecting rich or lean excursions of the air/fuel ratio by sensing the presence of oxygen in the exhaust gases. These systems usually operate at an average air/fuel ratio that is stoichiometric or slightly offset from that point. An acceleration enrichment feature sensitive to the instantaneous air/fuel ratio will assist in maintaining the emission levels in these systems.

Another of the more advantageous types of closed loop integral controllers is one which operates with a mixture so lean that the engine will just begin to run rough. The roughness threshold or average air/fuel ratio operating point for this system is set by the driveability criteria of the auto and acceleration enrichment for transients is necessitated to maintain this point. An acceleration enrichment feature sensitive to the instantaneous air/fuel ratio is therefore more important to this type of system because excursions for any length of time to the lean side of the threshold will be immediately felt by the operator as hesitations, roughness, or even stalls. Excursions on the rich side for any length of time will be defeating one of the primary purpose of the system, that of fuel economy.

SUMMARY OF THE INVENTION

An acceleration enrichment feature for closed loop fuel management systems is provided according to the invention. The enrichment feature is generated proportionately as a function of the combination of a change in an operator induced variable and a variable which is representative of the instantaneous air/fuel ratio from the operating condition of the engine.

In the preferred embodiment, the acceleration enrichment feature includes throttle sensing means for sensing the rate of change of throttle angle due to operator induced transients. The rate of change of throttle angle will not only be directly proportional to the amount of acceleration enrichment desired by the operator but also is the incipient indicator of the beginning of an acceleration and therefore a primary representation of the need for enrichment. By sensing the rate of change of throttle angle as the operator induced variable, the system will respond quickly and smoothly to the transients. The throttle sensing means generates a throttle signal proportional to the sensed rate of change, the magnitude of which is representative of the amount of enrichment or acceleration desired by the operator.

The acceleration enrichment feature further includes sensing means for sensing the roughness parameter of a closed loop integral roughness controller. This roughness variable, the magnitude of which is representative of the integral excursions to the rich and lean side of a roughness threshold, will be an indication of the instantaneous air/fuel ratio of the operating engine. The sensing means generates a roughness signal proportional to the roughness sensed, the magnitude of which is therefore indicative of the instantaneous air/fuel ratio of the engine.

The roughness signal or the instantaneous A/F ratio and the throttle signal or the operator induced variable are combined in combinational circuitry included in an acceleration enrichment circuit to provide an increase in the amount of acceleration enrichment for lean excursions of the A/F ratio from the desired operating point and to decrease the amount of acceleration enrichment for rich excursions of the A/F ratio from the desired operating point. The combinational circuitry then provides an AE signal dependent upon the operator induced variable and the instantaneous operating condition of the engine. The acceleration enrichment circuit is responsive to the acceleration enrichment signal to provide fuel enrichment proportionately to the signal when an acceleration is sensed.

Therefore, it is a primary object of the invention to provide proportional acceleration enrichment for a closed loop integral controller of a fuel management system which is dependent upon a transient condition in the control of the engine and the instantaneous operating condition of the engine.

Accordingly, another object of the invention is to provide an acceleration enrichment feature dependent upon the instantaneous air/fuel ratio of the engine.

Still another object of the invention is to provide the acceleration enrichment feature proportionately to the rate of change of throttle angle to sense operator induced transients incipiently for facile and rapid system response.

Yet another object of the invention is to provide an acceleration enrichment feature dependent upon a function of a roughness parameter to indicate instantaneous air/fuel ratio.

Yet still another object of the invention pertains to improving the driveability of a fuel management system using a closed loop integral roughness controller during operator induced transients.

Still another object of the invention is to provide an acceleration enrichment feature having improved driveability for a closed loop roughness system during operator induced transients without sacrificing fuel economy.

These and other objects, features, and aspects of the invention will be better understood from a reading of the following detailed description when taken in conjunction with the appended drawings wherein:

DETAILED DESCRIPTION

Figure 1:
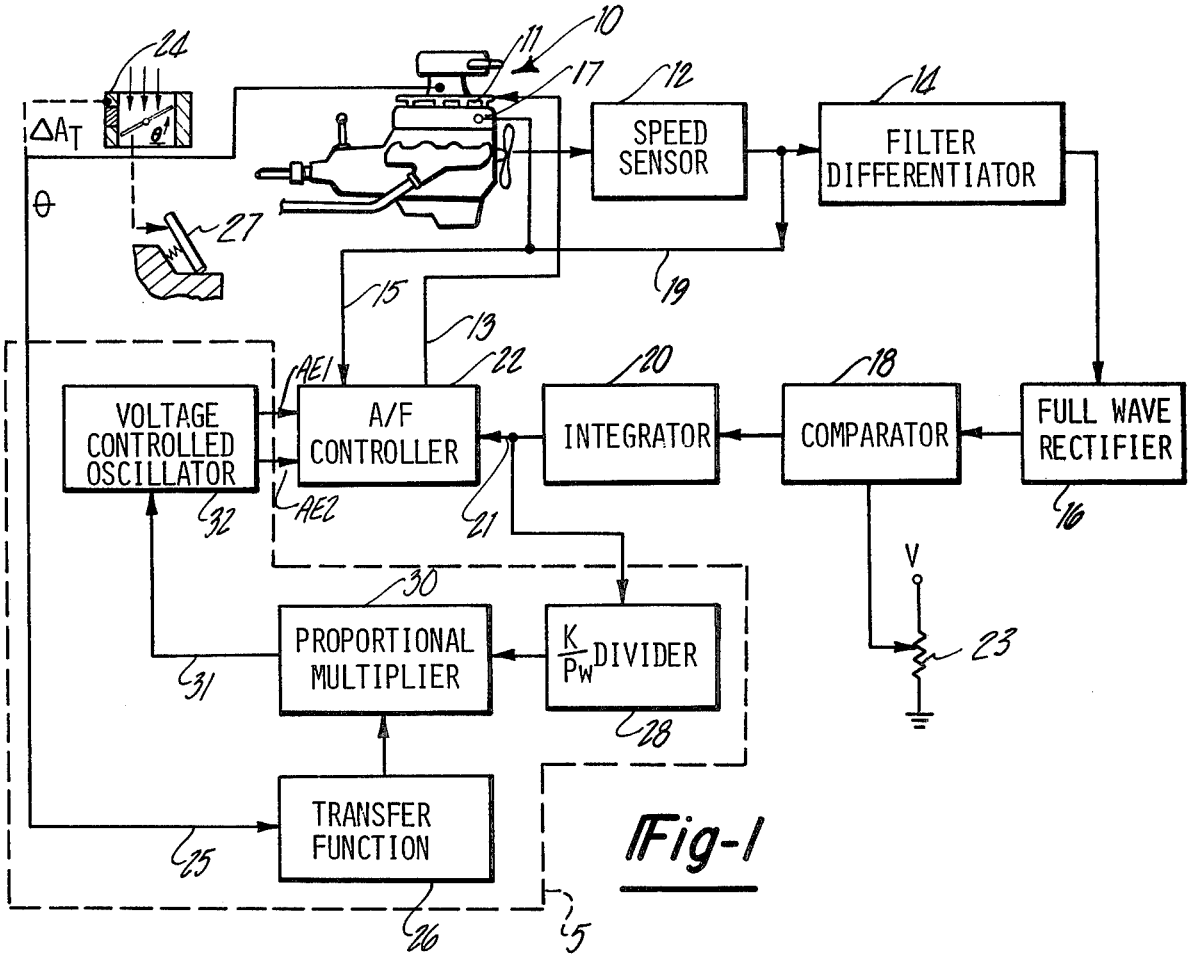
FIG. 1 is a system block diagram of a closed loop fuel management system with integral control, responsive to the level of roughness of an internal combustion engine, and including an acceleration enrichment feature in accordance with the invention.

With reference to FIG. 1 there is shown an internal combustion engine 10, including a fuel injection means 11, that is operable to deliver a fuel flow in a controllable way and thereby maintain a desired relationship to air flow. The fuel injection means 11 is generally adapted to vary the air/fuel ratio in response to different pulse widths from an air/fuel controller 22 which is operably connected via conductor bus 13.

The air/fuel controller 22 can be of the type known in the art for controlling the length of the fuel injection period by using one or more engine dependent parameters to either vary the point at which the injection period commences or to vary the point at which such injection period terminates. The air/fuel controller 22 of the presently preferred embodiment comprises a suitable pulse train generating device which maybe of a type disclosed in commonly assigned U.S. Pat. No. 3,734,068 issued May 22, 1973 to Junuthula N. Reddy and entitled "Fuel Injection Control System", the disclosure of which is herein expressely incorporated by reference.

As described in further detail in the indicated Reddy patent, the air/fuel controller 22 generates a pulse train of specially shaped voltage vs. time signals with each pulse having a specially shaped beginning portion for determining the commencement of each injection period in accordance with engine speed and a constant sloped ramp portion for terminating each injection pulse when the ramp portion intercepts a predetermined reference level related to air flow.

To receive such air flow and speed dependent intelligence, the air/fuel controller 22 is connected by a conductor 15 through a sensor 17 for sensing the air flow or parameter related thereto such as the manifold air pressure. Further, the air/fuel controller 22 is connected electrically to a speed sensor or tachometer 12 via conductor 19 to provide another parameter for input to the air/fuel controller via conductor 15. The speed sensor 12 in the present application comprises a toothed tachometer wheel suitably coupled to a crank shaft driven member (not shown) of the internal combustion engine 12 such as a fly wheel, ring gear or pulley thereof. Other suitable parameters of the operating engine can also be sensed and utilized in this manner.

Using the engine speed and the air flow intelligence thus provided air fuel controller 22 operates to modify the duration of the pulse injection period so as to maintain a desired relationship between the air flow and the fuel flow, where such desired relationship varies from an air/fuel ratio as low as 9:1 during cold engine starting conditions to slightly above the stoichiometric ratio of about 14.8:1 on completion of engine warm-up. It is evident that lower or higher air ratios can be used if necessary.

Figure 2:
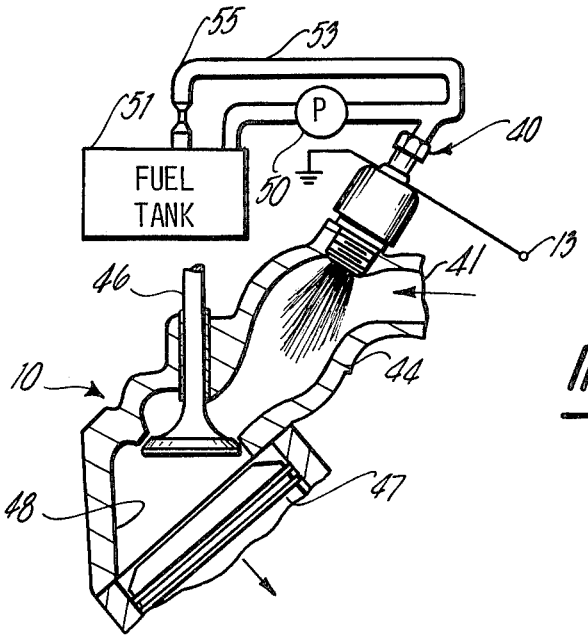
FIG. 2 is a partially sectioned, partially schematic view of an electronic fuel injector for the electronic fuel injection means of the closed loop fuel management system illustrated in FIG. 1.

FIG. 2 shows a partially schematic, partially broken away view of one of the plurality of injecting devices 40 utilized by the fuel injector means 11 and controlled by the variable pulse width of the A/F controller 22. The fuel injector 40 is of the electromagnetic solenoid valve type and is located by threadably mounting it within upwardly canted boss of an input manifold 44 of the engine 10. The injector 40 receives a supply of fuel from a fuel tank 51 acting as a reservoir through a filter orifice 55 and fuel line 53, which is continually pressurized and recirculated by a pump 50.

This continuous flow provides the source of fuel needed for injection when the device 40 is energized via one of the injector conductors 13. A variable length pulse on the injector conductor 13 will cause an opening of the solenoid actuated valve and a consequent atomizing spary of fuel into the intake manifold 44 which also has a port 41 communicating to the throttle body for inletting air to be mixed with the injected fuel. This injection, of course, occurs in synchronism with the opening or just before the opening of the intake valve 46 during the downstroke of a piston 47 of the engine 10. The air/fuel mixture then is drawn into the head of the combustion chamber 48 where it will be combusted as is conventional and thereafter exhausted.

The fuel injector means 11 shown usually has a plurality of the injectors 40, generally one per each single cylinder, with an eight-cylinder engine having two alternating banks of four injectors. Normal operation has all injectors of each bank fired in synchronism and thus two phased pulse trains of the variable width pulses from the air/fuel controller 22 will be provided to inject the fuel into the engine 10.

Returning now to the initial drawing, the fuel management system illustrated in FIG. 1 also comprises a roughness control loop which generates and applies to the air/fuel controller 22 an air/fuel ratio change command via conductor 21 that normally decreases the fuel injection period so as to increase the air/fuel ratio until the engine is biased to a limit so lean that the engine just begins to run rough. The roughness control loop then responds to this incipient roughness by momentarily decreasing the air/fuel ratio change command and thereby enriching the air/fuel ratio. Such an air/fuel ratio change command increases the fuel injection period by causing the ramp of the controller generated pulse train to intercept the reference voltage later as might be affected either by decreasing the slope of the ramp portion and/or by raising the reference voltage and operates oppositely for decreases in the fuel injection period.

The roughness control loop comprises basically the speed sensor 12 electrically connected to a filter, differentiator 14 which transforms the tachometer signal into a roughness voltage which is input into a full-wave rectifier 16 to be further transmitted to comparator 18. The comparator 18 having an input from a threshold means 23 is connected to an integrator 20 whose output controls the air/fuel controller 22 by the ratio change command. Speed sensor 12, and filter-differentiator 14 cooperate to form a roughness sensor whose output is indicative of the amount of roughness that the engine momentarily is experiencing which is generally sensed or detected as the instantaneous power differences or torque changes including accelerations and decelerations of speed changes in such parameters.

A roughness sensor of this type is more fully described in a commonly assigned U.S. Pat. application Ser. No. 249,440 filed on Apr. 24, 1972, now abandoned, in the name of Taplin et al and entitled "Serge Sensor Apparatus for a Prime Mover," the disclosure of which application is herein expressly incorporated by reference.

The differentiator 14 receives the speed signal from the sensor 12 and further attentuates frequencies outside a desired band and differentiates the remaining signal to generate a roughness signal which varies with at least the first derivative of the speed signal. Higher ordered derivatives maybe used and any sensor capable of delivering an electrical signal responsive to or indicative of the roughness of the internal combustion engine 12 is compatible with the disclosed feedback control loop.

The derivative signal is passed through the full-wave rectifier 16 to develop a voltage level which includes positive accelerations as well as negative decelerations in the changing speed characteristic of the engine. The voltage level from the full-wave rectifier 16 is input to the comparator 18 and a suitable source of reference voltage V is used to compare the output of the rectifier 16 with a predetermined amount of roughness from threshold 23.

If the engine is indicating more roughness than the amount of roughness set in the threshold, then the comparator 18 produces a comparison signal of one polarity or level and conversely when the roughness signal is lower than the threshold, the comparator will produce the opposite polarity or a different level. This comparison signal is communicated to the integrator 20 which provides an integral ramp from the levels and thus generates an air/fuel ratio change command that is supplied to the air/fuel controller 22. This integral command causes the controller to either continually shorten the period of the fuel injection pulse and thereby increase the air/fuel ratio towards a lean limit, as long as the output of the comparator 18 is of the first polarity, or to otherwise increase the period of the injection pulse to decrease the air/fuel ratio away from its lean limit as long as the output of the comparator is of the other polarity.

The magnitude of the threshold reference provided by the comparator is selected to correspond with the level of engine roughness at which the air/fuel mixture has made it as lean as possible to the point that the formation of exhaust gas constituent such as HC and CO is minimized without the driveability of a particular vehicle becoming unacceptable. To effect this tradeoff between vehicle driveability emission control, the setting of the roughness threshold may vary from one engine application to another. A roughness control loop such as that described is illustrated more particularly in a commonly assigned U.S. Pat. No. 3,789,816 issued to Taplin et al, the disclosure of which is herein expressly incorporated by a reference.

Thus, there has been described a closed loop integral controller which is responsive to a parameter or variable related to the instantaneous air/fuel ratio. It is to be understood that other variables other than roughness can be used to lengthen or shorten the basic fuel pulse to provide closed loop control for air/fuel controller 22. For example a closed loop $O_2$ sensor system operates similarly with a stoichiometric operating point (or reasonably close thereto) provided as an average air/fuel ratio by an integral control signal. The average operating point of the roughness controller similarly is the threshold set by the positions of the threshold means 23. Therefore, various closed loop integral controllers responsive to any variable indicating instantaneous air/fuel ratio can be utilized with the present invention.

The fuel management system also includes an acceleration enrichment feature 5 which is responsive to operator induced transient conditions such as a throttle position acceleration while being further modified by a variable of the roughness control loop as described above. The acceleration enrichment feature 5 comprises in part a throttle sensor 24 which forms an electrical output signal indicative of the position or change in throttle angle of the engine 10. The throttle position sensor 24 maybe a potentiometer or the like providing a voltage which is representative of its position. As is conventional, this throttle angle signal is an incipient indicator of operator induced transients which are produced by accelerator movements 27 of the driver to provide acceleration/deceleration information bearing on these conditions. The engine 10 will need increased fuel to match the increased air flow produced by the opening of the throttle plate substantially in direct proportion to the rate of change of the area of the throttle plate. Thus, the throttle angle is one of the more useful variables that change with operator induced accelerations or transients although others can be used with varying success.

The signal from the sensor 24 is then communicated to a transfer function circuit 24 which differentiates and modifies the signal by inducing a lag which is approximately equal to a system lag as more fully described hereinafter. This modified throttle signal is then connected to and mixed in proportional multiplier 30 with a signal from a divider 28. The divider 28 has an input from roughness control loop, via conductor 21, which when divided into a constant K and mixed with the modified signal from the transfer function circuit 26, will produce an output indicative of the acceleration enrichment needed to a voltage control oscillator 32 over enrichment control line 31.

In operation, the divider 28 receives a signal input from the roughness loop which is proportional to the amount of roughness or instantaneous air/fuel ratio the engine is experiencing. This signal maybe taken at many places in the roughness loop, for example at the output of the filter differentiator 14. Further, process signals indicative of the engine roughness or roughness correction are available at the output of the integrator 20 or the output of the air/fuel controller 13.

In the preferred embodiment of the invention, the output of the integrator 20 which consists of a positive or negative going ramp is chosen because of the ease in which such signal can be further processed. This signal then is used as the divisor of a proportional constant K with the quotient being output to the multiplier 30. This provides a signal which is inversely proportional to the actual amount of roughness in the control loop and the instantaneous A/F ratio of the system. For example, if the roughness correction is large, the output of the divider is relatively small and conversely if the roughness correction is small the output of the divider is relatively large.

The output of the divider 28 and the output of the transfer function circuit 26 are mixed in the proportional multiplier 32 to provide an output signal which is dependent on both of these parameters. Therefore, if there is a throttle signal from the throttle angle sensor 24 that indiciates the air/fuel ratio should be enriched for accelerations, this is modified by the roughness signal which will enrich it even more if the engine were in a rough condition or lean, then it would if the engine were in a rich running condition. This enrichment signal then is transmitted on the enrichment control line 31 and is dependent on both the parameters of roughness and throttle angle to enable a voltage controlled oscillator VCO 32 which changes frequency in relationship to the magnitude of the voltage input over the control line 31.

Preferably, the output of the VCO 32 is mixed (ORed) with the main or base fuel injection pulses in the air/fuel controller 22 for each injection time to input a greater number of pulses or fewer, depending upon the frequency generated by the VCO.

The VCO 32 will communicate two groups of the variable frequency pulses to the air/fuel controller via acceleration enrichment lines AE1, AE2. The two groups will be phased to provide acceleration enrichment to both banks of the eight cylinder engine as the air/fuel controller switches between banks as was previously described. Alternatively, the variable frequency output of VCO 32 could be utilized to lengthen the basic air/fuel pulse width of the controller 22.

The acceleration enrichment feature can be more easily envisioned and explained by reference to the waveform diagrams FIGS. 5*a* through FIG. 5*d*. FIG. 5*d* illustrates how the frequency of the VCO 32 changes for changes in the area of the throttle plate according to the invention. The base calibration shows that increasing rates of change of the throttle angle, the first derivative of throttle position, will produce higher frequencies which are translated into more acceleration injection pulses to be mixed with the regular or base air/fuel injection pulses of the air/fuel controller 22. A linear curve has been shown and the slope of this curve can be adjusted for differing applications. Further, more complex base calibration curves can be used without departing from the invention. This base calibration curve of the VCO 32 is shifted to the area between the base calibration and the upper curve to higher frequencies at all changes of throttle area when the engine is running in a relatively lean state and to the area between the base calibration and the lower curve to lower frequencies when the engine is running in a relatively rich state. It is evident that the acceleration enrichment provided will be modified by the instantaneous operating condition of the engine according to an important object of the invention.

Figure 5A:
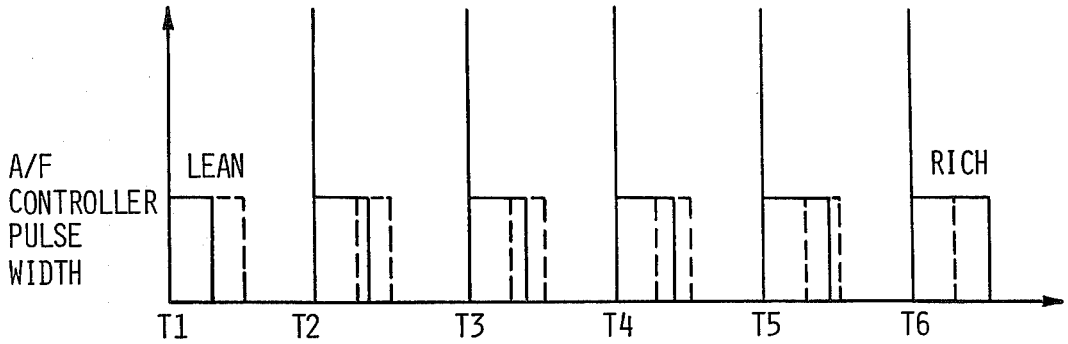
FIG. 5 a–d are waveform diagrams of various signals found throughout the fuel management system illustrated in FIG. 1.

FIG. 5*a* generally shows the changes in the fuel injection pulse length due to the roughness of control loop as can be seen in the time period $T_1$. The time periods $T_1$–$T_6$ are injection times for the system and the pulse widths have been exaggerated relative to them to clarify the operation. The base calibration fuel pulse (dotted line) can be modified or shortened by the roughness control loop to where it is fully leaned out and the engine will become rough as indicated by the solid line. Time periods $T_2$ through $T_6$ show varying amounts of roughness as the solid line moves between the roughness threshold and a full width base calibration for the fuel controller 22.

The frequency of the hunting will depend on the integration rate and the time constants of the system and the average air/fuel ratio will be the threshold value. Lean and rich is this sense, of course, means values of the air/fuel ratio on either side of the threshold value and does not necessarily apply to lamda numbers unless the desired operating point is stoichiometric.

Figure 5B:
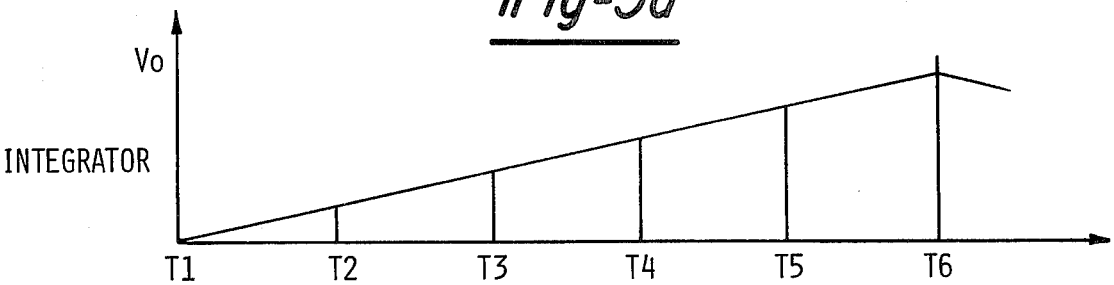

FIG. 5b shows the output voltage of the integrator 20 at a minimum during $T_1$, meaning that the air/fuel ratio is at its maximum leanness, and then gradually becoming richer in relationship to time because of the integral control of the roughness loop to a point $T_6$ where the engine begins to run rich once more. The point $T_6$ illustrates where the comparator 18 switches from one level to the other. Thereafter, the integrator 20 provides a negative ramp until the threshold is sensed once more.

Figure 5C:
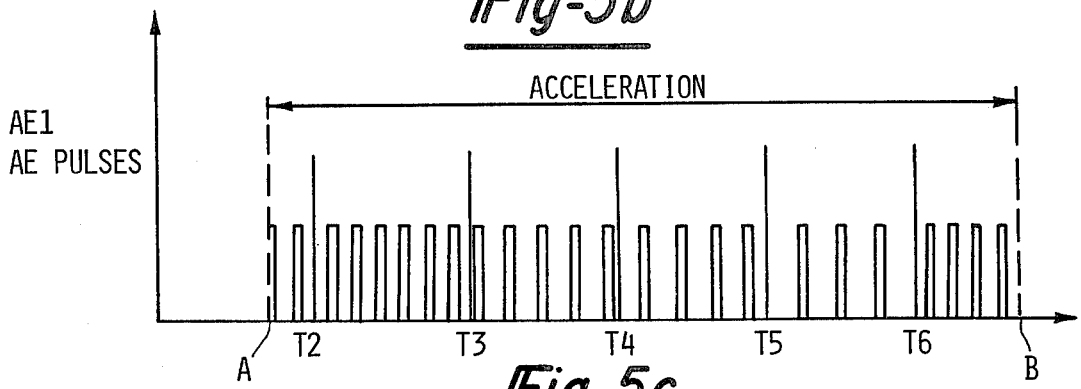
Figure 5D:
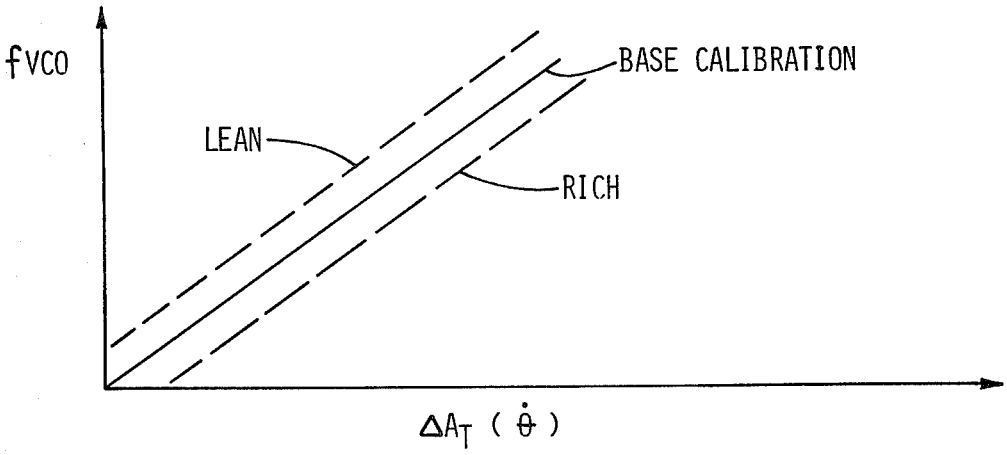

FIG. 5*c* illustrates the acceleration enrichment frequency change of the VCO in relationship to the integrator voltage shown in FIG. 5*b*. An acceleration signal has been detected between time periods $T_1$ and $T_2$ at Point A and continues to after time period $T_6$ at Point B. During time period $T_2$ to $T_3$, the VCO will be controlled to output a certain frequency indicative of the rate of change of the throttle angle and this base frequency will be increased as the engine is running in a lean condition. As the engine begins to respond to the closed loop roughness sensor in time periods $T_3$, $T_4$ and $T_5$, the frequency gradually lessens to the base calibration dependent on the rate of throttle angle change only. At the operating point, $T_6$, the correction for instantaneous air/fuel ratio will be zero. After time periods $T_6$ when the control loop senses that the engine is beginning to lean again, the frequency starts to increase until the acceleration command ceases slightly after $T_6$.

Figure 3:
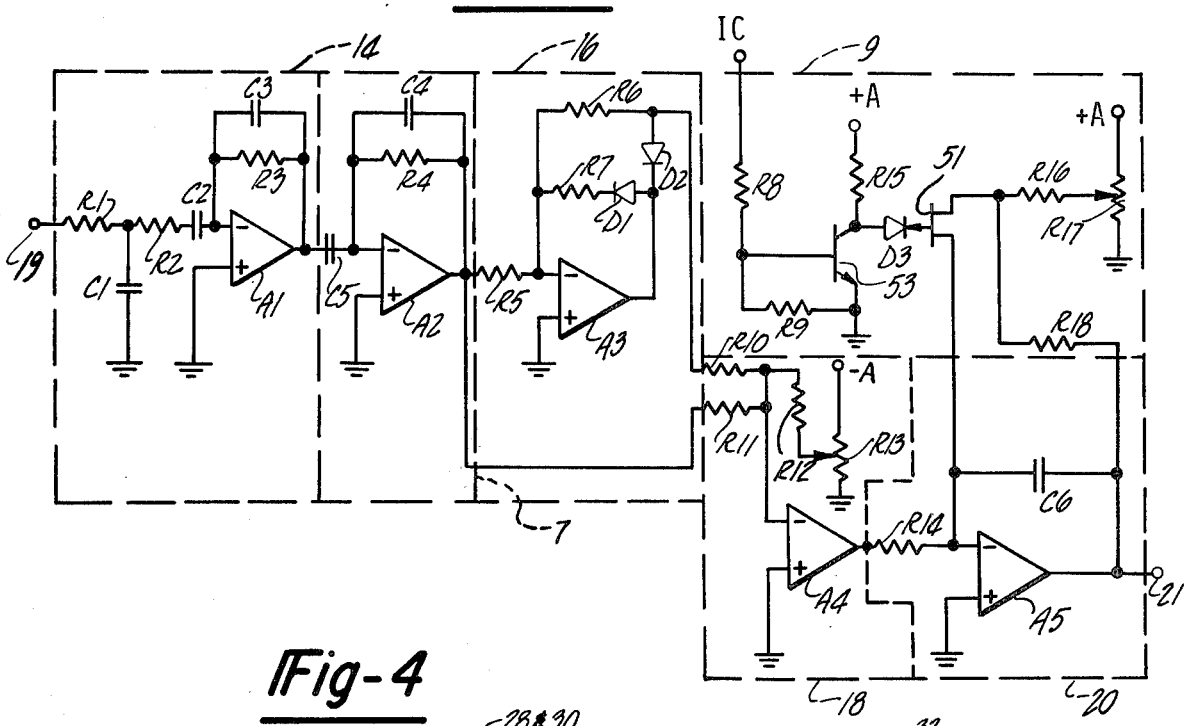
FIG. 3 is a detailed electrical schematic view of circuitry comprising the integral roughness control loop for the fuel management system illustrated in FIG. 1.

With reference now directed to FIG. 3, there is shown the detailed circuitry comprising the roughness control loop in the block diagram of FIG. 1. The filter differentiator 14 comprises three filter stages of resistor capacitor combinations R1–C1, R2–C2 and R3–C3, in combination with a differentiator comprising operational amplifier A1, feedback resistor R3, and capacitor C2. This filter differentiator is more particularly described in the above-referenced Taplin application and produces an output from the amplifier A1 that varies with the first derivative of the speed signal or, in this case, the accelerations and decelerations applied through the differentiator input 19 from the tachometer or speed sensor.

This roughness signal comprising the accelerations and decelerations of the engine is applied to a further filter stage, high pass filter 7, which filters out that portion of the roughness due to operator induced transients as indicated in the above-mentioned U.S. Pat. No. 3,789,816. The roughness signal comprises very small accelerations and decelerations that are fairly high in frequency which are related directly to the leanness or richness of the engine and slower, large amplitude roughness signals that are related to the accelerations and decelerations produced by the operation of the engine throttle plate. The high pass filter 7 substantially filters out all the operator induced roughness and passes the engine roughness signal to the rectifier 16.

The filter 7 comprises inverting operational amplifier A2 having a parallel connection of a capacitor C4 and a resistor R4 connected between its output and inverting input with a low frequency blocking capacitor C5 connected also to the inverting input of the amplifier.

The rectifier 16 thereafter comprises a half wave rectifier having amplifier A3 with a diode-resistor combination R7, D1 connected between the output and the inverting input and further having the parallel combination of a reverse poled diode D2 and a resistor R6 connected between its output and inverting input. The output of the amplifier A3 is taken from the junction of the resistor R6 and the annode of the diode D2 via a resistor R10 for input to the comparator 18. A further input to the comparator 18 from rectifier 16 is provided from the output of the filter 7 via a resistor R11. This circuit combination produces a linearized full wave rectifier output to the comparator as described in U.S. Pat. No. 3,789,816. The full wave rectifier 16 is to provide a roughness signal comprising accelerations and decelerations for both positive and negative peaks. The comparator 18 will now be more fully described which compares the roughness output from the rectifier 16 to a threshold.

The roughness bias or threshold voltage is developed at a node formed at the inverting input of an amplifier A4 by the divider combination of a resistor R12 and a resistor R13 being connected between a negative source of voltage, −A, and ground. A wiper on the variable resistance R13 can be utilized to vary the roughness threshold for different engine applications as is known. The node or inverting input of A4 formed at the junction of R10, R11, and R12 produces an analog addition of the roughness voltage and the threshold.

The output of the comparator 18, which is either a high or low level, depending upon the level of roughness, is thereafter integrated by the integrator circuit 20 comprising an amplifier A5 with an integrating capacitor C6 connected between the output and the inverting input. A resistor R14 connected at the inverting input cooperates with the capacitor C6 to provide a predetermined ramp or integration rate. The integrator output 21 subsequently is connected as indicated in the following FIG. 4 to the AE feature 5 and also provides an incrementally changing control voltage to the air/fuel controller 22 as indicated in FIG. 1. The output of the integrator 20 is a positive going ramp for roughness signals in excess of the threshold and a negative going ramp for roughness signals less than the threshold.

An initial condition air/fuel ratio maybe set by an initial condition circuit 9. The initial condition circuit comprises a NPN transistor 53 connected at its collector or a source of positive voltage via a resistor R15 and having its emitter terminal suitably grounded. A bias and signal network formed between an initial condition terminal IC and ground is produced by the series combination of a resistor R8 and a resistor R9. The initial condition pulse is applied at starting and warm up to terminal IC from a circuit (not shown) sensing these conditions. The junction of the resistors is connected to the base of the transistor 53 to divide a positive or initializing voltage to the transistor 53 to turn it on.

The switching transistor S3, which is further connected as its collector to a unijunction transistor 51 via a diode D3, will, when energized, produce a voltage to turn the unijunction transistor 51 on. Upon the operation of the unijunction transistor 51, the common junction terminal of a resistor R16 and a feedback resistor R18 is connected to the inverting input of amplifier A5 to provide the preset voltage via the moveable wiper arm on a divider resistor R17 that has been connected between a negative supply and ground.

Figure 4:
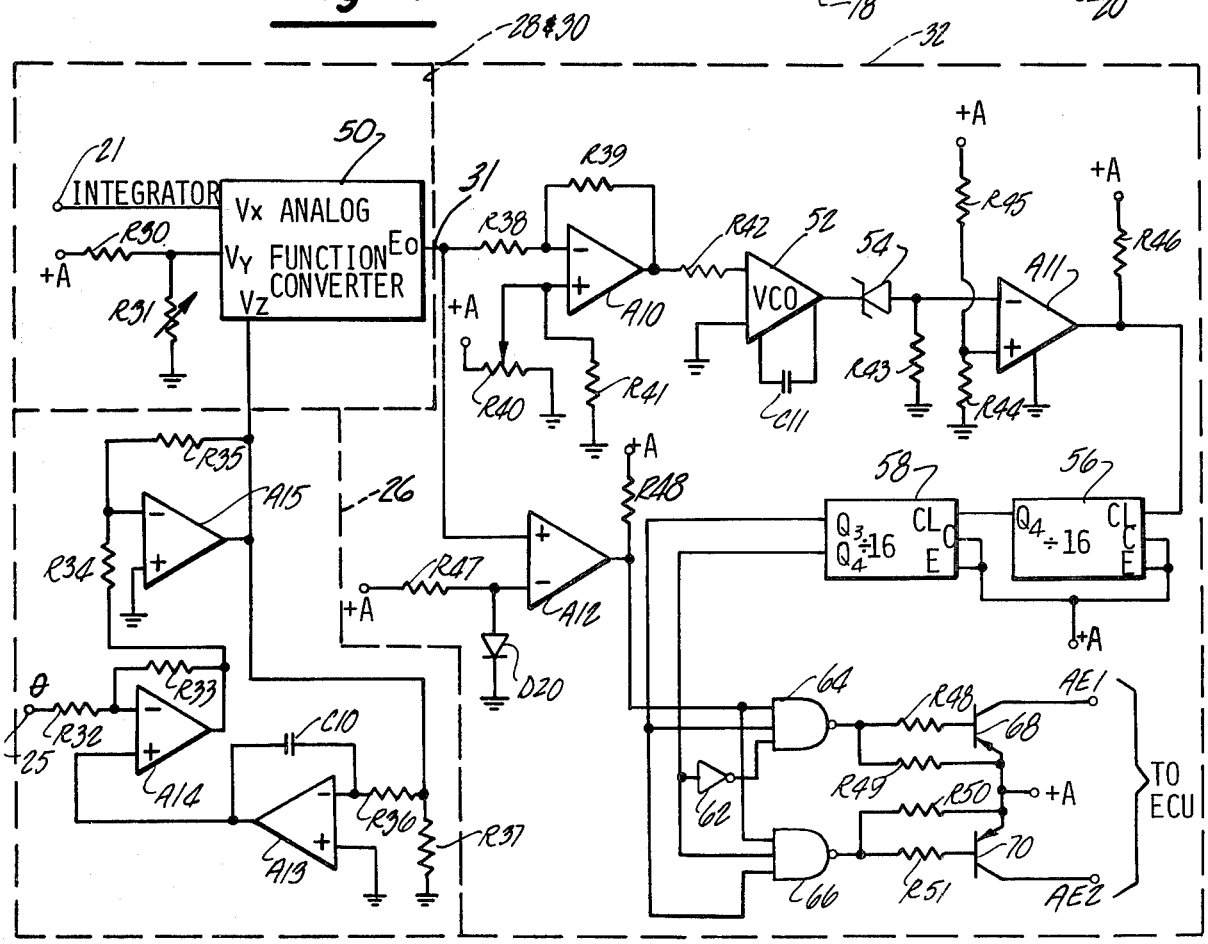
FIG. 4 is a detailed electrical schematic view of circuitry comprising the acceleration enrichment feature for the fuel management system illustrated in FIG. 1.

With reference now to FIG. 4, the detailed circuitry comprising the acceleration enrichment feature 5 will now be explained in greater detail. The output of the integrator 20 (FIG. 3), which is representative of the roughness of the engine and therefore indicative of the instantaneous air/fuel ratio, is input to a $V_x$ input of an analog function converter 50. A $V_y$ input of the converter 50 is a variable voltage produced by the divider combination of a resistor R30 and a resistor R31. The resistor R31 is variable so that the input voltage to the $V_y$ input of the converter 50 is variable over the range of zero to +A. A third input to the converter, $V_z$, is provided by the transfer function circuitry 26 comprising that circuitry in the dotted block.

The input to the $V_z$ node of the converter 50 is the throttle angle position $\theta$ modified by the transfer function circuitry 26. This circuitry comprises generally a differentiator and a lag inducing filter to produce a rate of throttle change signal proportionally from the throttle angle position that is time coincident with the change in manifold pressure. The transfer function circuitry 26 comprises the operational amplifiers A13, A14 and A15 with their associated bias components and connecting elements.

The throttle position $\theta$ is input to the inverting input of the amplifier A14 which acts to sum the throttle position over a resistor R32 with the output of the amplifier A13. The gain of the amplifier A14 is produced by the combination of resistors R33, R32 where the resistor R32 produces negative feedback by being connected from the output of the amplifier to the junction of the resistor R32 and the inverting input of the amplifier A14. Amplifier A15 is an inverting amplifier with a gain of one having its noninverting input grounded and a gain resistor R35 connected between the output and the inverting input and an input resistor R34 connected between the output of the amplifier A14 and the inverting input. The output of the inverting amplifier A15 is fed into the inverting input of amplifier A13 via a resistor R36. The amplifier A13 performs an integrating and differentiating function by having a capacitor C10 connected between its output and the inverting input. The noninverting input of amplifier A13 is connected to ground. A proportional attenuation is provided by connecting a resistor R37 between the output of the amplifier A15 and ground at the junction with the resistor R36. In operation, this circuit performs the transfer function of:

$$TP(OUT)/TP(IN)=TC_1S/TC_2S+1 \text{ or rearranging} \quad (1)$$

$$TP(OUT)=TC_1TP(IN)/TC_2-TP(OUT)/S\ TC_2 \quad (2)$$

where S is the La Place operator, TP(IN) is the throttle position input to terminal 25, TP(OUT) is the modified throttle position, and $TC_1$, $TC_2$ are time constants The $TC_1S$ term of equation 1 performs a differentiation of the throttle position signal TP(IN) to give the angular rate of change of the throttle as an instantaneous quantity. $TC_1$ is the differentiator time constant and can be adjusted for sensitivity of the circuit as desired. The denominator of Equation 1 performs or induces a lag, $TC_2S+1$, which will tend to match the lag of the system and provide a more real model of the actual mechanical and electrical lags of the system. The time constant $TC_2$ can be empirically determined for its initial setting. For example, the ingested air will lag behind the proportional AE signal during accelerations and it is envisioned that the lag will be set to compensate for this and other physical variables.

Equation 1 can be simplified to that of Equation 2 where it is also seen that Equation 2 maybe implemented in the transfer function circuitry 26 where amplifier A14 produces the gain of $TC_1/TC_2$ by having resistors R32, R33 be equal to $TC_1$, $TC_2$ respectively, and where the inversion of the signal output signal TP(OUT) is performed by the double inversion of the amplifiers A14, A15 and the inverting of the integrator A13. The output of amplifier A15 being the TP(OUT) signal and the input communicated to the integrator A13 attenuated by $1/TC_2$ by the resistor combination R36, R37.

The analog function converter 50 then will produce an output which is the multiplicative and divides result of the combination of the inputs $V_x$, $V_y$ and $V_z$, particularly the converter provides the transfer function of $V_yXV_x/V_z=E_o$. The pulse width correction from the integrator 20 then is divided into the output of the transfer function circuitry 26 and multiplied by the constant K which is input to the $V_y$ terminal of the converter to produce the desired output as hereinbefore described. The constant K is adjusted for a zero correction to the throttle angle position when the roughness threshold is sensed.

The multiplication and division could be performed by many different types of circuits but the analog function converter produces an analog signal representative of the division and multiplication in a facile manner in the art. Particularly, the function converter could be a multi-function converter made by the Burr-Brown Corporation of Tucson, Ariz. with a model number of 4302.

The output of the converter 50 is directly communicated to an inverting input of operation amplifier A10 operating as a linear amplifier via an input resistor R30. The linear amplifier A10 additionally has a gain resistor R39 connected at the inverting input of the amplifier A10 with the other terminal of the resistor connected to the output of the amplifier. A small offset voltage to the noninverting input of amplifier A10 is formed by a resistor R41 being connected between that terminal and ground and a variable resistor R40. The variable resistor R40 having a connection at its variable terminal connected to the noninverting input and having a positive voltage connected to one terminal with its opposite terminal grounded produces a very small voltage to the input by adjustment of the wiper for operation in the linear range.

The output of the linear amplifier A10 is communicated to an integrated circuit 52 operating as a voltage controlled oscillator VCO, with an input resistor R42 connected between the output of the amplifier A10 and the input of the VCO. The other input is grounded and a timing capacitor C11 sets the frequency of the oscillation.

As the voltage varies from the amplifier A10, the frequency of the output of the VCO 52 will either increase or decrease to provide an indication of this modulation. The output of the VCO is limited and shaped by a divider combination of a Zener diode 54 and a resistor 43. In combination the Zener is connected at its cathode to the output of the VCO 52 and at the annode to the one terminal of the resistor 43 while the other terminal of the resistor 43 is connected to ground.

Thus, the Zener will provide a voltage limiter once its breakdown voltage is exceeded to provide a limited or clipped output from the VCO 52 to the inverting input of a shaper amplifier A11. Amplifier A11 is connected as a comparator and will shape the output from the VCO 52 and limiter into a square wave because of the rapid rise of the amplifier. Providing an offset voltage or comparison voltage for the noninverting input of amplifier A11 is the divider combination of a resistor R44 and a resistor R45. A pull-up resistor R46 is connected to the output of the amplifier A11.

After the output is shaped by the amplifier A11, it is communicated via the CL input to a divide by 16 counter 56. The output of the counter 56, Q4, is connected to the CL input of another divide by 16 counter 58. Common to the count input C of both counters and the enable input E of both counters 56, 58 is a positive supply of voltage plus A. Thus, the counters 56, 58 are operable as serial frequency dividers which produce an output pulse train having a frequency which is the frequency of the VCO 52 divided by their count. It is evident that counter 56 and counter 58 can be simplified into a single counter. The frequency of the output counters 56, 58 are system dependent. The number of AE pulses for a certain voltage of the acceleration enrichment signal via line 31 will be different for different engines. To allow the frequency to be set, the VCO can have an adjustable base calibration or a variable number of division stages can be used.

The outputs of the counter 58 $Q_3$ and $Q_4$ are utilized to drive a NAND gate 64 and a NAND gate 66. The output $Q_3$ is connected to an input of the NAND gate 64 and to the input of the NAND gate 66. Likewise, the $Q_4$ output of the counter 58 is connected directly to the input of the NAND gate 66 and is inverted by an inverter 62 before being communicated to an input of the NAND gate 64. The $Q_4$ output alternately enables the NAND gate 64 every half cycle and the $Q_3$ output produces pulse widths of the desired size. Thus, the pulse trains formed at the output of the NAND gates 64, 66 are of fixed width with a 25 percent duty cycle and spaced apart a half cycle.

A further enabling signal to the input of the NAND gate 64 and the input of the NAND gate 66 is the output of the amplifier A12, which acts as a switch to disable the NAND gates 64 and 66 when there is no output from the converter 50. When the converter does have a voltage present which is larger than the offset voltage formed by the combination of resistor 47 and a diode D20 connected to the noninverting input, the amplifier A12 will produce an enabling signal via a resistor R48 to the inputs of the NAND gates to thereby enable them.

Normally, driving transistors 68, 70 are biased in off condition by a positive voltage +A applied to their bases via a bias resistor R49 and a bias resistor R51, respectively. When fully enabled the NAND gates 64, 66 will sink current through an input resistor R48 and an input resistor R50 to produce conduction in the transistors 68, 70, respectively. The NAND gates 68, 70 are alternately enabled by the acceleration enrichment pulses from the VCO 52. These acceleration enrichment pulses from the NAND gates 64, 66 flow to turn on PNP driving transistors 68 and 70 to provide the alternating trains of AE pulses via terminals AE1 and AE2 to the air/fuel controller 22. The air/fuel controller 22 will then combine the AE1 signal and AE2 signal with the main fuel pulses to drive the alternate banks of injectors for the eight-cylinder engine shown in the drawing, FIG. 1.

While a preferred embodiment of the invention has been illustrated and described to advantage, it will be obvious to those skilled in the art that various modifications and changes maybe made thereto without departing from the spirit and scope of the invention as defined by the appended claims.

What is claimed:

1. An acceleration enrichment feature for a closed loop fuel management system of an internal combustion engine wherein the management system measures at least one engine operating parameter indicative of the air/fuel ratio of the engine and utilizes that parameter to correct the instantaneous air/fuel ratio to a desired average value by integral control, said AE feature comprising:

means for detecting an operator induced parameter and generating an acceleration signal proportional to a characteristic of the induced parameter;

means for detecting said engine parameter indicative of the air/fuel ratio of the engine and for generating a correctional signal proportional to that parameter; and acceleration enrichment means for generating an acceleration enrichment signal to the fuel management system in response to said acceleration signal and said correctional signal, the fuel management system controlling the air/fuel ratio of the engine in response to said enrichment signal and the integral control.

2. A method of acceleration enrichment for a closed loop fuel management system of an internal combustion engine wherein the fuel management system measures at least one engine operating parameter indicative of the air/fuel ratio of the engine and utilizes that parameter to control the instantaneous air/fuel ratio to a desired average value with an integral control signal, said acceleration enrichment method comprising:

detecting an operator induced parameter representative of a desired acceleration;

generating an acceleration signal proportional to the magnitude of the induced parameter;

detecting the instantaneous air/fuel ratio of the engine;

generating a correctional signal proportional to the detected instantaneous air/fuel ratio;

generating an acceleration enrichment signal to said fuel management system in response to said acceleration signal and in response to said correctional signal; and controlling the air/fuel ratio of the engine in response to said enrichment signal and in response to said integral control signal with said fuel management system.

3. An acceleration enrichment circuit for controlling the air/fuel ratio of a closed loop fuel management system of an internal combustion engine having a throttle plate comprising:

means for sensing the amount of roughness in the operation of an internal combustion engine and generating a roughness signal proportional to said amount of roughness, said roughness signal being representative of the instantaneous air/fuel ratio of the engine;

throttle sensing means for sensing the rate of change in the angle of the throttle plate of the internal combustion engine and for generating a throttle signal proportional to said rate of change; and acceleration enrichment means for generating acceleration enrichment pulses the frequency of which are proportional to a desired amount of acceleration for the internal combustion engine, said AE means responsive to increase the frequency of acceleration enrichment pulses for the roughness signal beyond a threshold and to decrease the frequency of acceleration enrichment pulses for the roughness signal below a threshold, said AE means further responsive to said throttle signal to proportionately change said acceleration enrichment frequency for a change in the throttle signal, said acceleration enrichment frequency being dependent upon both said roughness signal and said throttle signal.

4. An acceleration enrichment circuit as defined in claim 3 wherein said throttle sensing means further includes filter means for introducing a lag in said throttle signal proportional to the lag in the change of manifold pressure due to the change of throttle angle.

5. An acceleration enrichment circuit as defined in claim 3 wherein said acceleration enrichment means includes division means for dividing a constant number by said roughness signal to provide a correction signal that is inversely proportional to the roughness signal.

6. An acceleration enrichment circuit as defined in claim 5 wherein said acceleration enrichment means includes multiplication means for combining said correction signal and said throttle signal to provide a frequency control signal the amplitude of which is inversely proportional to the roughness signal and directly proportional to the throttle signal.

7. An acceleration enrichment circuit as defined in claim 6 wherein said constant is chosen such that said correction signal becomes a multiplicative factor of one when said instantaneous air/fuel ratio as represented by the roughness signal is equal to the threshold value, whereby acceleration enrichment is proportional to said throttle signal without correction.

8. An acceleration enrichment circuit as defined in claim 7 wherein said acceleration enrichment means includes voltage controlled oscillator means for generating said acceleration enrichment pulses at differing frequencies in response to said frequency control signal, said oscillator means increasing frequency in response to an increasing amplitude of the frequency control signal and decreasing frequency in response to a decreasing amplitude of the frequency control signal, wherein said fuel management system combines the AE pulses with the basic fuel delivery to enrich the air/fuel ratio for the operator induced transients.

9. A method of fuel control during operator induced transient conditions for a closed loop fuel management system regulating the air/fuel ratio of an internal combustion engine including a roughness sensor, said method comprising:

sensing the instantaneous roughness of the internal combustion engine to determine whether the fuel mixture is relatively lean or relatively rich;

providing a roughness signal proportional to the amount of roughness sensed;

sensing the rate of change of the throttle angle caused by operator induced transients;

providing a throttle signal proportional to the rate of change of throttle angle sensed;

generating an acceleration enrichment signal during said transient conditions to supplement said roughness closed loop system wherein said AE signal is dependent on changes in the throttle signal and is dependent on changes in the roughness signal such that the AE control signal is generated as a function which is directly proportional to the rate of change of throttle angle and inversely proportional to the richness of the air/fuel ratio of the internal combustion engine; and changing the air/fuel ratio of the engine in response to said acceleration enrichment signal to increase fuel flow during operator induced transients.

10. A method of transient fuel control as defined in claim 9 wherein said steps of sensing the rate of change of the throttle angle and providing the throttle signal includes:

differentiating the angular position of the throttle with respect to time to produce the sensed rate of change;

modifying said sensed rate of change by a transfer function to introduce a lag substantially equivalent to the delay in change of manifold pressure due to the change of throttle angle.

11. An acceleration enrichment feature for a closed loop fuel management system of an internal combustion engine wherein the management system measures at least one engine operating parameter indicative of the air/fuel ratio of the engine and utilizes that parameter to correct the instantaneous air/fuel ratio to a desired average value by integral control, said AE feature comprising:

acceleration sensing means for detecting an operator induced parameter representative of a desired acceleration and for generating an acceleration signal proportional to the magnitude of the desired acceleration;

engine sensing means for detecting said engine parameter that is indicative of the air/fuel ratio of the engine and for generating a correctional signal proportional to that parameter; and acceleration enrichment means for generating an acceleration enrichment signal which is in addition to said integral control and for decreasing the air/fuel ratio of the engine in response to said enrichment signal wherein said AE means is responsive to said acceleration signal and is further responsive to said correctional signal, said AE means providing enrichment proportionately to the acceleration signal and increasing the enrichment if the correctional signal indicates a relatively lean operating condition and decreasing the enrichment if the correction signal indicates a relatively rich operating condition to maintain said average air/fuel ratio during transients.

12. A fuel management system for an internal combustion engine, said management system comprising:

an air/fuel ratio controller for controlling the amount of fuel delivered to the cylinders of said engine by sensing the manifold pressure and speed of the engine; said controller converting said sensed speed and pressure parameters to a fuel pulse width by applying the parameters to a fuel schedule;

a closed loop integral control means cooperating with said A/F controller to modify said pulse width, said integral control means including a roughness sensor for determining the amount of roughness the engine is experiencing and for generating a roughness signal proportional thereto, the integral control means having said roughness sensor electrically connected to a comparator means which determines whether said roughness signal is greater than a threshold value to generate a signal of one level if it is and a signal of a second level if it is not, said comparator means connected to an integrator means providing a voltage ramp increasing with time while said comparator is generating said first level and providing a voltage ramp decreasing with time while said comparator is generating said second level, wherein said fuel pulse width of said A/F ratio controller is modified by said voltage ramps to increase the fuel for the increasing ramp and to decrease the fuel for the decreasing ramp; said voltage ramps thereby being an indication of the instantaneous air/fuel ratio of the system;

acceleration enrichment means for modifying the air/fuel ratio during operator induced transients, said AE means sensing an operator induced transient parameter and generating an acceleration signal proportional thereto, said acceleration signal being corrected in the acceleration means by the instantaneous air/fuel ratio of the engine, wherein said correction occurs by combining said ramp voltages with said acceleration signal in a combination circuit included in said AE means to increase enrichment for relatively lean air/fuel ratios and to decrease enrichment for relatively rich air/fuel ratios, whereinafter said corrected acceleration signal is communicated to said air/fuel controller and combined with said fuel pulse width to enrich the air/fuel ratio during operator induced accelerations.

13. A fuel management system as defined in claim 12 wherein said AE means further includes:

a throttle sensor to sense the angular position of the throttle plate as the operator induced transient that indicates an acceleration, said sensor generating an angular position signal indicative of the position sensed.

14. A fuel management system as defined in claim 13 wherein said AE means further includes:

transfer function circuit means connected to said throttle sensor for differentiating the angular position of the throttle with respect to time to output a throttle signal that is proportional to the rate of change in the position of the throttle.

15. A fuel management system as defined in claim 14 wherein said transfer function circuit means includes:

filter means for inducing a lag in said throttle signal that is equivalent to the lag in the change of manifold pressure due to the change in throttle angle.

16. A fuel management system as defined in claim 15 wherein said acceleration enrichment means includes:

divider means for dividing a constant by said ramp voltages to provide a correction signal indicative of the amount of correction needed to be applied to said throttle signal, said correction signal being small for large voltage values of said ramps where the air/fuel ratio is relatively rich and being large for smaller voltage values of said ramps where the air/fuel ratio is relatively lean.

17. A fuel management system as defined in claim 16 wherein said divider means includes said constant chosen such that the correction signal is equal to one when the instantaneous air/fuel ratio is at the threshold value.

18. A fuel management system as defined in claim 17 wherein said acceleration enrichment circuit includes a proportional multiplier for combining the correction signal and the throttle signal wherein said multiplier generates said AE signal as the product of the multiplier which is dependent on both the throttle and correction signal.

19. A fuel management system as defined in claim 18 wherein said AE means further includes:

voltage controlled oscillator (VCO) means for generating a pulse train with a set pulse width, said oscillator means coupled to said multiplier means wherein said frequency of the pulse train is changed in response to the acceleration enrichment signal from the multiplier means, whereby the oscillator means provides a base calibration curve of frequencies proportionately to the rate of change of throttle angle which curve is shifted to curves of higher frequencies during relatively lean operations of the engine and to curves of lower frequencies during relatively rich operations of the engine.

20. A fuel management system as defined in claim 19 wherein said VCO means further includes:

enablement means for comparing said acceleration enrichment signal with a threshold and for enabling the VCO means if said acceleration enrichment signal is greater than said threshold.

* * * * *